US005465437A

United States Patent [19]

Herman

[11] Patent Number: 5,465,437

[45] Date of Patent: Nov. 14, 1995

[54] BATHING APPLIANCE FOR HANDICAPPED PERSONS

[76] Inventor: William David Herman, Dogtail Corners Rd. - R.R. 1 Box 523A, Wingdale, N.Y. 12594

[21] Appl. No.: 289,785

[22] Filed: Aug. 12, 1994

[51] Int. Cl.[6] ..... A47K 3/12

[52] U.S. Cl. ..... 4/611; 4/604; 4/560.1; 297/344.24

[58] Field of Search ..... 4/604, 611, 560.1, 4/561.1, 562.1, 563.1, 564.1, 565.1, 566.1; 297/344.24, 344.21

[56] References Cited

U.S. PATENT DOCUMENTS

| | | | |
|---|---|---|---|
| 1,566,161 | 12/1925 | Moore | 297/344.24 |
| 3,022,518 | 2/1962 | Hayden | 4/562.1 |
| 3,542,424 | 11/1970 | Bingley et al. | 297/344.24 |
| 3,815,163 | 6/1974 | Sullivan | 4/562.1 |
| 4,150,445 | 4/1979 | Bailey | 4/560.1 |
| 4,316,634 | 2/1982 | Roesler | 297/344.24 |
| 4,620,686 | 11/1986 | Conant | 297/344.24 |
| 4,628,550 | 12/1986 | Walton . | |
| 4,733,418 | 3/1988 | Luther . | |
| 4,905,327 | 3/1990 | Boublil . | |
| 4,951,328 | 8/1990 | Potvin | 4/560.1 |
| 4,998,305 | 3/1991 | Davis . | |

FOREIGN PATENT DOCUMENTS

| | | | |
|---|---|---|---|
| 2206007 | 1/1980 | Germany | 4/560.1 |
| 282924 | 1/1965 | Netherlands | 297/344.24 |

OTHER PUBLICATIONS

Instruction Sheet and photo of wall-mounted swivel chair for bathing.

*Primary Examiner*—Henry J. Recla
*Assistant Examiner*—Charles R. Eloshway
*Attorney, Agent, or Firm*—Leo Zucker

[57] ABSTRACT

A bathing appliance enables a handicapped person to wash comfortably and safely inside a shower stall or in a bathtub. The appliance includes a base frame constructed to rest firmly on a floor of the stall or bathtub, and a chair seat on which the handicapped person can sit when entering and leaving the bathing enclosure and while washing inside the enclosure. The chair seat has a first swivel mechanism fixed to a bottom portion of the seat to allow the seat to be supported for relative movement over the base frame. The base frame has a second swivel mechanism that forms a fixed base pivot axis normal to the floor of the bathing enclosure. An extension arrangement has a third swivel mechanism at a top end for engaging the first swivel mechanism of the chair seat, for swiveling movement about an extension axis parallel to the base pivot axis. The extension arrangement also has a fourth swivel mechanism at the bottom end for engaging the second swivel mechanism of the base frame, for swiveling movement about the base pivot axis. The extension arrangement is constructed to support the chair seat above the base frame, while allowing the seat to move between positions outside the bathing enclosure where the person can mount or dismount the seat, and positions inside the bathing enclosure where the person can bathe comfortably while seated.

13 Claims, 4 Drawing Sheets

BATHING APPLIANCE FOR HANDICAPPED PERSONS

BACKGROUND OF THE INVENTION

1. Field of the Invention

The present invention relates generally to equipment for assisting physically impaired persons to bathe with little discomfort, and more particularly to a bathing appliance for the handicapped that can seat and support a person safely when entering, leaving or bathing in a shower stall or bathtub.

2. Description of the Known Art

There is a great, current awareness now on the part of the public concerning the special needs of physically handicapped persons. Widespread recognition of the need to accommodate the handicapped and to provide them with appropriate means for enjoying a modern lifestyle, resulted in passage of the Americans With Disabilities Act of 1990, Public Law 101-336.

Public and commercial buildings intended to accommodate large groups of persons, e.g., schools, office buildings, restaurants, hotels, motels and lodges; must allow the handicapped including wheelchair-bound persons equal access to all available facilities. Specially equipped elevators, low-level water fountains, and rest rooms with fixtures designed to accommodate the wheelchair-bound person, are examples of how previously ignored needs of the disabled are now being served.

Persons confined to wheelchairs, whether at home or in a lodging facility, must of course wash and bathe themselves on a regular basis. Thorough body cleansing requires an individual either to stand inside a shower stall or to be seated in a bathtub. Understandably, it may be difficult if not impossible for a wheelchair-bound person to position himself or herself within the confines of a bathing enclosure without being physically supported by another individual. Accordingly, a disabled person may be reluctant to travel away from home for long periods of time unless in the company of a close companion.

Equipment is known that is intended to allow a physically impaired person to be seated and to swing over a fixed arc into and out of a bathtub/shower-stall unit. U.S. Pat. No. 4,628,550 issued Dec. 16, 1986, discloses shower chair apparatus including a stabilizer bar that rests horizontally on a bathroom floor just outside a bathtub enclosure. A vertical post extending upward from the bar forms a swivel axis for a support arm of the chair. Installation of the apparatus of the '550 patent requires the use of bumper pads to clamp the apparatus on the outside wall of the bathtub/shower stall unit, for steady bracing of the chair.

U.S. Pat. No. 4,733,418 (Mar. 29, 1988) shows bathing apparatus for assisting the handicapped, including a stanchion post that extends vertically from the floor to the ceiling, outside of a bathtub. The frame of a seat assembly is pivoted to the post. U.S. Pat. No. 4,905,327 (Mar. 6, 1990) also discloses a vertical support column running from the floor to the ceiling outside and next to a bathtub. The column supports a seat that can be elevated and swiveled with respect to the column.

SUMMARY OF THE INVENTION

An object of the invention is to provide a bathing appliance that will enable a physically impaired person to bathe comfortably when inside a bathing enclosure such as a shower stall or a bathtub.

A further object of the invention is to provide a bathing appliance that can be used in most cases by a wheel chair bound person, without assistance.

Another object of the invention is to provide a bathing appliance for the handicapped that can be installed easily and without requiring structural alterations to the bathing enclosure with which it is used.

A further object of the invention is to provide a bathing appliance for the handicapped capable of use in shower stalls and in bathtubs of the kind ordinarily used at hotels, motels, lodges, and other public facilities.

Yet another object of the invention is to provide a bathing appliance for the handicapped, having relatively few parts and which occupies minimal space when transported in an automobile or a van.

According to the invention, a bathing appliance includes base frame means sized and arranged to rest firmly on a floor of a bathing enclosure, and a chair seat on which a handicapped person may sit when entering and leaving the enclosure, and while bathing inside the enclosure. The chair seat has a bottom portion and first swivel means fixed beneath the bottom portion to allow the chair seat to be supported for relative movement over the base frame means, and the base frame means has second swivel means for forming a fixed base pivot axis normal to the floor of the bathing enclosure. Extension means has third swivel means at a top end for engaging the first swivel means of the chair seat for swiveling movement about an extension axis parallel to the base pivot axis, and fourth swivel means at a bottom end of the extension means for engaging the second swivel means of the base frame means for swiveling movement about the base pivot axis. The extension means is constructed and arranged to support the chair seat above the base frame means while allowing the seat to be moved between a position outside the bathing enclosure where a person can either mount or dismount the seat, and a position inside the enclosure at which a person can bathe comfortably while seated.

In one embodiment, the bathing enclosure is a shower stall having an entry step, and the base frame means of the appliance includes an outside foot portion that spans the entry step to stand on a floor surface just outside the shower stall.

In another embodiment, the bathing enclosure is a bathtub with a side wall, and the base frame means of the appliance includes an outside leg portion that spans the side wall to stand on an outside floor surface adjacent the bathtub side wall.

Preferably, the extension means comprises a first rigid extension member and a second rigid extension member pivoted to one another for swiveling movement about an axis parallel to the extension axis. Each of the first and the second members is formed so that the chair seat can be located at any desired position within the bathing enclosure upon swiveling movement of the extension members relative to one another and to the base frame means.

For a better understanding of the invention, reference is made to the following description taken in conjunction with the accompanying drawing, and the scope of the invention will be pointed out in the appended claims.

DETAILED DESCRIPTION OF THE INVENTION

Figure 1:
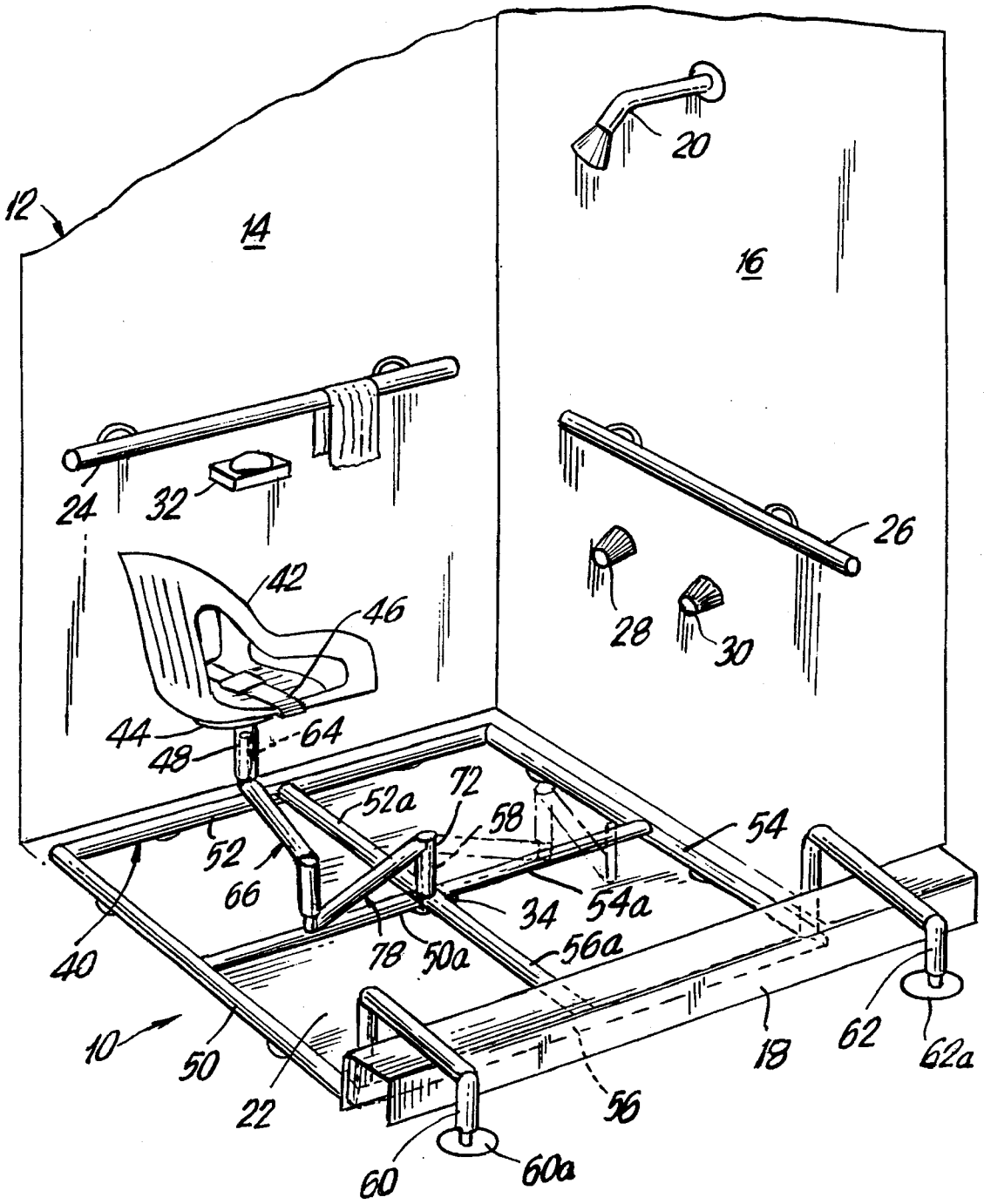
FIG. 1 is a perspective view of an embodiment of the present bathing appliance, for use in a shower stall.

FIG. 1 is a view of a bathing appliance 10 for use by handicapped persons to bathe or wash inside of a shower stall 12.

The shower stall 12 may be of the kind found in homes, hotels, motels, and public lodging facilities generally. The stall 12 is usually defined by three side walls, two of which 14, 16 are shown in FIG. 1. The stall 12 also has an entry step 18 over which a person must pass when entering or leaving the stall. A shower curtain or a hinged glass door (not shown) are ordinarily supported vertically over the entry step 18.

A shower spray head 20 extends inside the stall from the wall 16 to provide shower water from a certain height above shower floor 22. A horizontal support bar 24 is mounted on the wall 14 and another horizontal support bar 26 is mounted on the wall 16. Preferably, the bars 24, 26 are sufficiently sturdy to allow a person to exert their weight on either bar 24, 26 when standing in the stall 12 or if seated on the present appliance 10.

A hot water control valve handle 28 and a cold water valve handle 30 project from the wall 16, and a soap dish 32 is provided on wall 14. A water drain 34 is located centrally of the shower floor 22. Persons unable to enter and stand inside the shower stall 12 because of a physical impairment may, nonetheless, bathe comfortably inside the stall with the aid of the present bathing appliance 10.

The appliance 10 includes a base frame 40 a major portion of which is dimensioned and arranged to rest firmly on the shower floor 22. A chair seat 42 made of sturdy plastics or other waterproof material, is provided to enable seating of a person upon entering or leaving the shower stall 12, and while bathing inside the stall. The chair seat 42 has a bottom support portion 44 (see FIG. 4) of stainless steel or other rustproof metallic material, and a seat belt 46 with webbing that is anchored to the support portion 44. Interlocking buckles at the free ends of the belt 46 hold the person securely about the waist while seated on the chair seat 42.

A first swivel sleeve 48 is fixed (e.g. by welding) to the bottom support portion 44, and projects vertically downward beneath the chair seat 42. See FIG. 4.

The base frame 40 is formed from rods or tubes of stainless steel or other rigid rustproof material. The major portion of the base frame 40 has a generally rectangular perimeter defined by straight outer frame sections 50, 52, 54, and 56. Interior frame sections 50*a*, 52*a*, 54*a*, 56*a* are each fixed at one end to a corresponding outer frame section, and at their opposite end support a swivel rod 58 that extends vertically upward from the center of the major portion of the base frame 40, normal to the floor 22 of the shower stall 12.

The base frame 40 also has a foot portion comprised of two inverted "U"-shaped tubular members 60, 62 that are fixed at one end near the corners of the frame 40 adjacent the entry step 18 that borders the shower stall floor 22. The members 60, 62 span over the entry step 18 and have foot pads 60*a*, 62*a* that are adjustable in the vertical direction and can be brought into contact with a floor surface just outside the shower stall adjacent the entry step 18.

Figure 2:
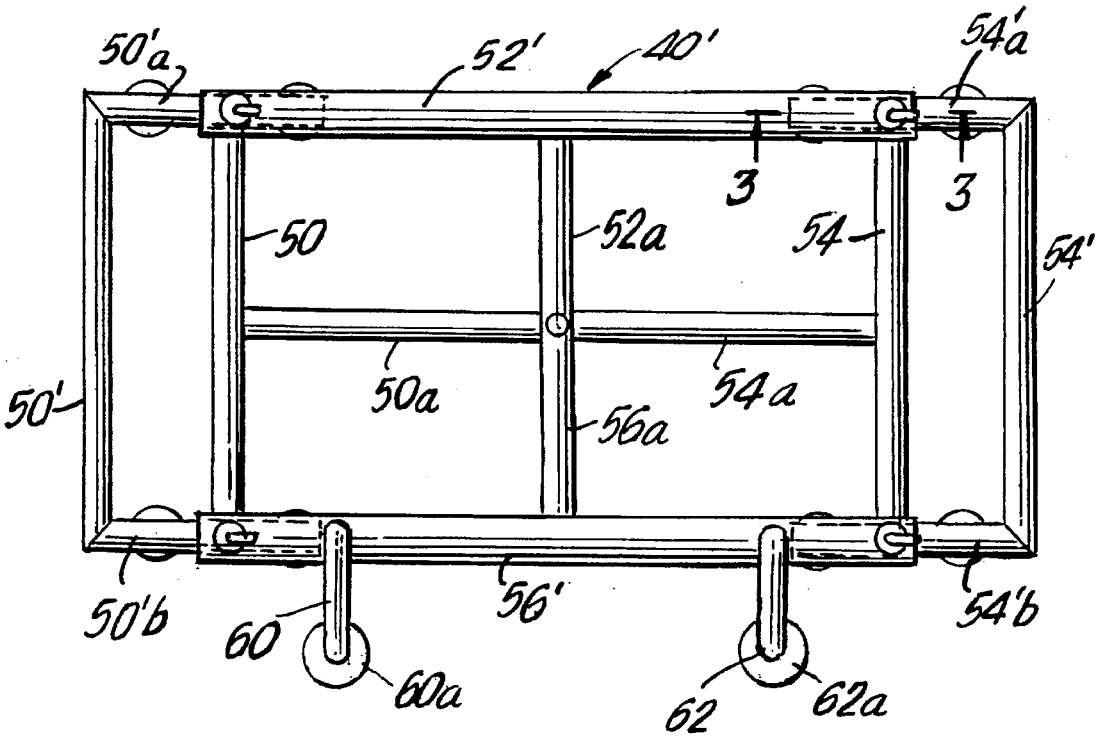
FIG. 2 is a plan view of a base frame in the appliance of FIG. 1, the frame being modified to be extensible in width.

FIG. 2 is a view of a modified frame 40' for use in the bathing appliance 10 of FIG. 1. Parts of the frame 40' that are the same or similar to parts of the base frame 40 have corresponding reference characters.

Figure 3:
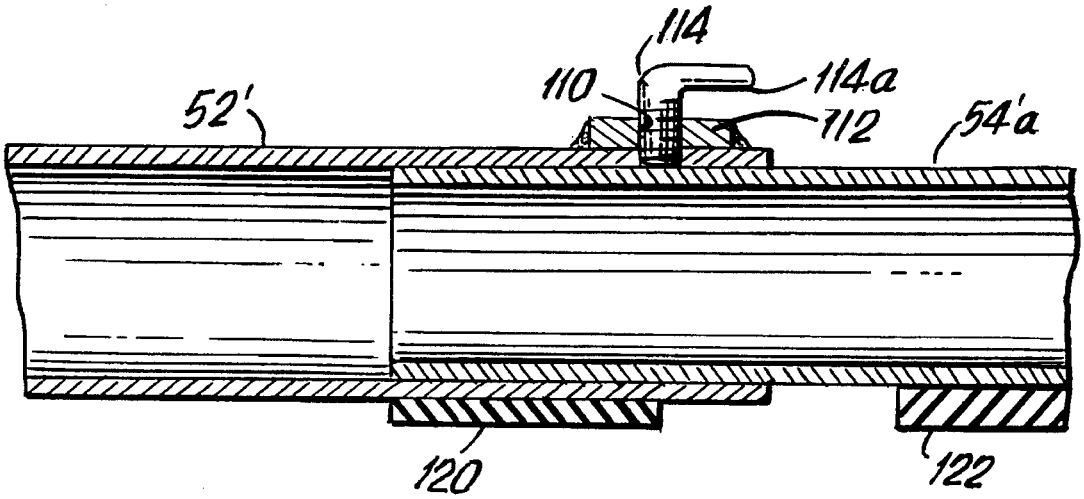
FIG. 3 is an enlarged sectional view of a locking portion of the extensible base frame in FIG. 2.

Frame 40' has opposed side sections 50' and 54' with telescoping legs 50'*a*, 50'*b* and 54'*a*, 54'*b* arranged to telescope within opposed tubular side sections 52', 56'. As described below, the base frame 40' can be adjusted to rest firmly on the stall floor 22 by sliding the side sections 50', 54' relative to the rest of the frame 40' until the sections abut the stall walls near the floor 22 The extensible sections 50', 54' are then locked in position as shown in FIG. 3.

Specifically, an opening 110 is formed through the wall of each of the tubular sections 52', 56' near the open ends of each section. Threaded nut members 112 are fixed (welded) to each section with the opening in each nut member 112 in registration with a corresponding opening 110. A threaded lock screw member 114 with a wing or bat head 114*a* is turned in each nut member 112 until the screw member passes through the opening 110, and is locked against the outer circumference of one of the telescoping legs of the side sections 50', 54'.

Rubber blocks 120, 122 may also be fixed to the bottom sides of the base frame sections. Because the telescoping frame sections may have unequal outside diameters, the blocks 120, 122 can be of different thicknesses so as to stabilize the frame 40' as the frame rests on the shower stall floor 22. Blocks 120, 122 will also protect the floor 22 from scratching by any of the frame sections.

The first swivel sleeve 48 extending beneath the chair seat 42 from seat support portion 44, receives a pivot rod 64 that projects vertically upward from a top end of a rigid extension member 66. A nylon sleeve bushing 68 (see FIG. 4) is fixed against the inner circumference of the swivel sleeve 48. The sleeve 48 is closed at its top end by a part of the seat support portion 44. The inner diameter of the bushing 68 is such as to receive the pivot rod 64 with a tight tolerance, to prevent wobbling of the chair seat 42 about the axis of the pivot rod 64. In a typical application, the length of the swivel sleeve 48 from its closed top end, to the open bottom end of the sleeve 48 into which the pivot rod 64 is inserted, measures about seven inches. The overall length of the pivot rod 64 is preferably about eight and one-half inches, and a clearance gap of about one-eighth inch is left between the bottom end of the sleeve 48 and a horizontal tubular member 70 to which the rod 64 is welded. The gap prevents interference between the sleeve 48 and member 70 when the chair seat pivots about the rod 64.

The horizontal tubular member 70 can be fabricated from stock the same as that used for the straight sections of the base frame 40. For example, tubular member 70 may be a stainless steel pipe measuring ten inches long and having an outer diameter of one and one-half inches, with a wall thickness of one-eighth inch. The pivot rod 64 may also be formed of stainless steel with a diameter of one inch. The rod 64 is welded structurally to the right end of the member 70 as viewed in FIG. 4, with the bottom end of the rod 64 substantially aligned with the lower right edge of the member 70. A swivel sleeve 72 having a closed top end 72*a*, is structurally welded to the end of the tubular member 70 opposite the pivot rod 64, with the axis of the sleeve 72 parallel to the axis of rod 64. Sleeve 72 has an open bottom end facing vertically downward, opposite the closed top end 72*a*. The sleeve 72 may measure typically about eight inches in axial length. Sleeve 72 also has a nylon bushing 74 fitted tightly over the length of its inside circumference. A rigid support pipe 76, which may be of a smaller diameter than the tubular member 70, is structurally welded at one end to the outer periphery of the sleeve 72 near the bottom end of the sleeve, and at the other end to the tubular member 70 and the bottom of the pivot rod 64. Accordingly, the extension member 66 will exhibit very great strength and rigidity when assembled as apart of the present bathing appliance 10, as described below. Extension member 66 will hereafter be referred to as the first or the upper extension member of the appliance 10.

Bathing appliance 10 also includes a second or a lower extension member 78. The lower extension member comprises a pivot rod 80 which projects vertically upward from one end of a horizontal tubular member 82 to which the pivot rod is welded, with the lower end of the rod 80 substantially aligned with the lower left edge of the member 82 as viewed in FIG. 4. Because the diameter of the rod 80 is less than the inner diameter of the tubular member 82 (as is the diameter of the pivot rod 64 relative to the inner diameter of the tubular member 70), the rods 80 and 64 can be securely welded at points on the inner circumference of the members 82 and 70. A clearance gap is defined between the bottom end of the sleeve 72 and the tubular member 82 to which the pivot rod 80 is welded, so as to allow relative pivotal movement between the two parts without interference.

Tubular member 82 may be fabricated of the same stock as the tubular member 70 of the upper extension member 66, but the axial length of the member 82 may be less than that of the member 70 in certain applications, noted below. A swivel sleeve 84 having a closed top end 84*a*, is structurally welded to the end of the member 82 opposite the pivot rod 80, with the axis of the sleeve 84 parallel to the axis of the rod 80. Sleeve 84 may be of the same material and dimensions as the sleeve 72 of the upper extension member 66. A nylon bushing 86 is fitted tightly to the inner circumference of the sleeve 84. A support pipe 88 is welded at one end to the tubular member 82 and the bottom of the pivot rod 80, and at the other end to the periphery of the swivel sleeve 84 near the bottom of the sleeve.

The swivel rod 58 which projects vertically upward from the base frame 40, is inserted through the open bottom end of the sleeve 84 of the lower extension member 78. The clearance between rod 58 and the bushing 86 in the sleeve 84, is made tight so as to avoid wobbling as the lower extension member 78 swivels about the rod 58.

Figure 4:
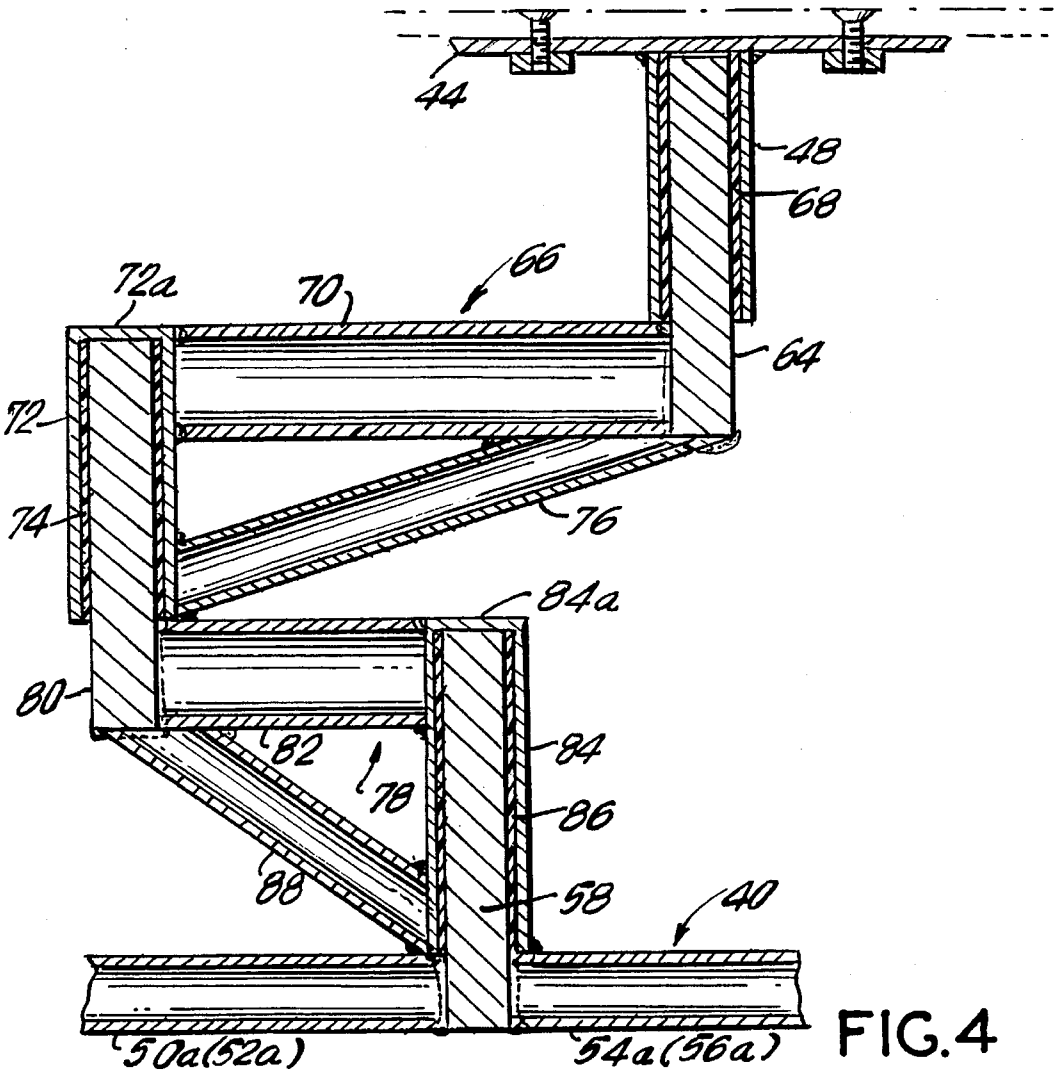
FIG. 4 is an enlarged sectional view of assembled chair extension members in the appliance of FIG. 1.

To avoid water and moisture accumulation in swiveling parts of the bathing appliance 10, it is preferred that each of the chair seat sleeve 48, the upper extension member sleeve 72, and the lower extension member sleeve 84, have a closed top end as shown in FIG. 4. Water originating from the shower spray head 20 or from splashing by a person using the appliance 10 in a shower stall or a bathtub, will thus be prevented from accumulating in the swiveling mechanisms of the appliance 10.

Figure 5:
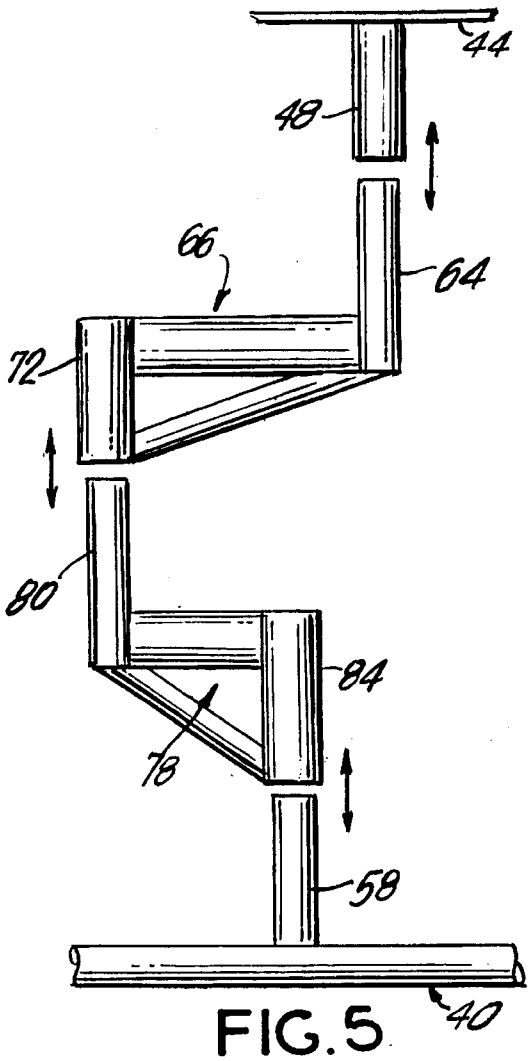
FIG. 5 is a view showing the assembly of the extension members in FIG. 4.

FIG. 5 is a view illustrating the assembly of the chair seat 42, extension members 66, 78 and the base frame 40, with one another. As shown in figure, the mentioned parts connect with a tight sliding fit between the rods and associated sleeves on the appliance parts, so that the appliance 10 can be assembled or disassembled with relative ease. When in a disassembled state, the parts of the appliance 10 can be arranged so as to occupy relatively little trunk or cargo space in an automobile or a van.

To assemble and use the appliance 10 at the site of the shower stall 12 (see FIG. 1), the base frame 40 (or 40') is positioned on the shower floor 22 with the "U"-shaped members 60, 62 straddling the entry step 18. If necessary, the extensible side sections of the modified frame 40' are adjusted to abut the confronting walls of the shower stall 12 near the floor level, so that the base frame is effectively locked against rotational motion relative to the shower floor 22. Each of the foot pads 60*a*, 62*a* is adjusted so that the pad stands firmly on the floor surface outside the entry step 18, and serves to prevent sliding movement of the base frame relative to the stall floor 22.

The lower extension member 78 is then placed in position by sliding the sleeve 84 over the base frame swivel rod 58. Next, the upper extension member 66 is placed in position by sliding its sleeve 72 over the rod 80 of the lower extension member. Finally, the sleeve 48 extending beneath the chair seat 42 is slid axially over the rod 64 of the upper extension member 66. The assembled configuration shown in FIGS. 1 and 4 is then obtained.

Means for locking the three sleeves 48, 72, 84 in axial position on the corresponding rods 64, 80, 58 may also be provided. For example, one or more set screws may pass through threaded openings in the sleeve walls to engage annular recesses in the rods, once the sleeves are properly positioned on the rods.

A wheelchair bound person may approach the entry step 18 from outside the shower stall, and urge the chair seat 42 over the step 18 by, for example, grasping one or both extension members 66, 78. The person then transfers himself or herself from the wheelchair to the seat 42, and is then free to move to any desired position over the shower floor 22 because of the articulated connection arrangement between the seat, the extension members and the base frame of the appliance 10.

For example, the person can move in the seat 42 easily toward the wall 16 to adjust the hot and cold water valve handles 28, 30, and then move toward the wall 14 to grasp a bar of soap from the dish 32 and a wash cloth on the support bar 24. Rather than have to stand to adjust the direction of the shower spray from the head 20, the person can move freely on the seat 42 to any location within the shower stall 12, so as to receive just the amount of shower water that he or she wants.

Figure 6:
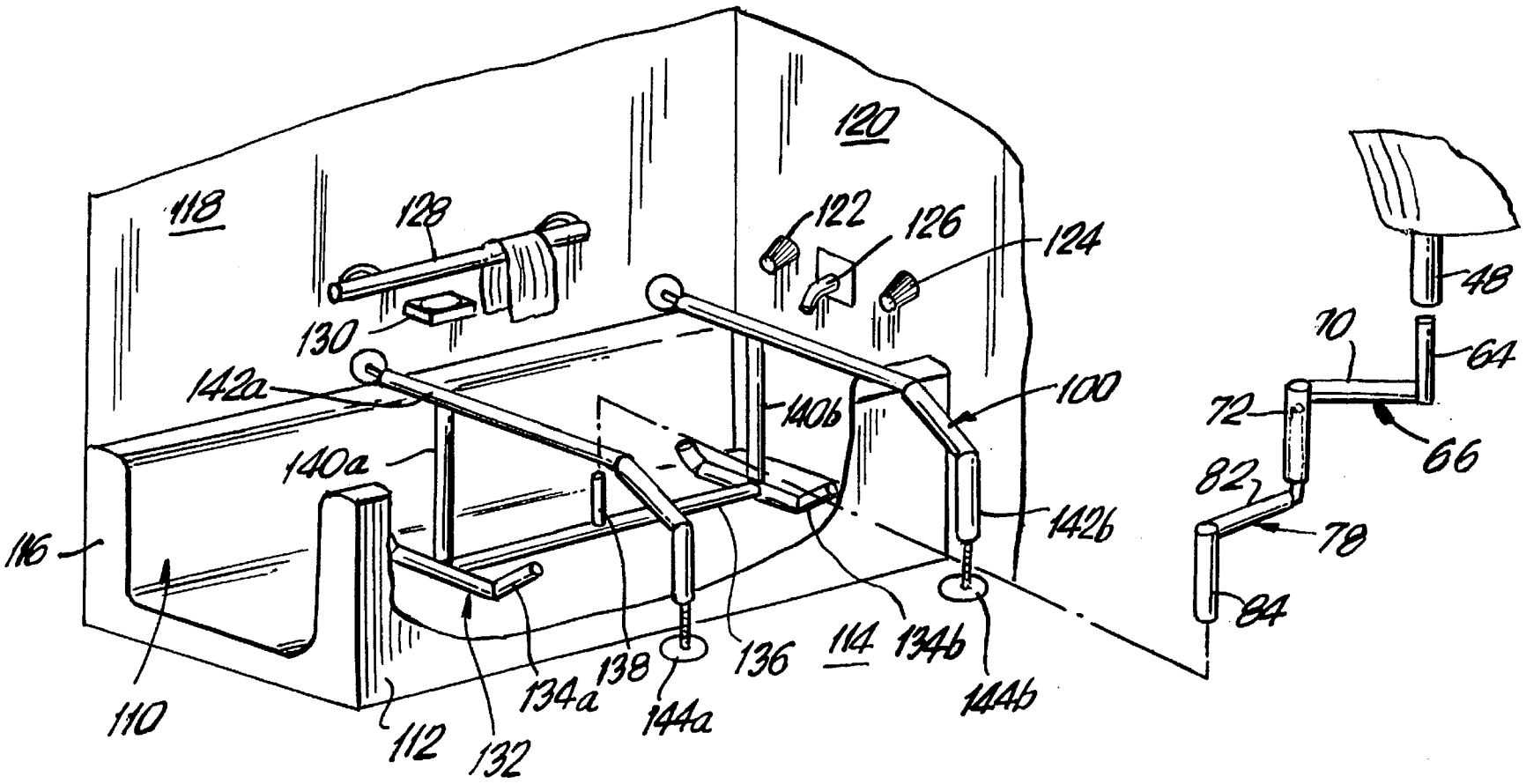
FIG. 6 is a perspective view of a second embodiment of the present bathing appliance for use in a bathtub.

FIG. 6 is a view of a second embodiment of the present bathing appliance 100 for use in a bathtub 110.

The bathtub 110 has an outer side wall 112 next to an outside floor surface 114, e.g., a bathroom floor. The bathtub 110 also has an inner side wall 116 abutting a bathroom wall 118. A back end of the bathtub, at the left side of FIG. 6, may be enclosed by another bathroom wall (not shown) or by a rear wall of the bathtub itself, and the front end of the bathtub abuts a bathroom wall 120. Hot and cold water faucet knobs 122, 124, project from the wall 120, and a bathtub water spout 126 directs water of a desired temperature to fill the bathtub 110. A conventional drain and drain stopper mechanism, neither of which is shown in the drawing, are also provided.

A horizontal support bar 128 is fixed to the wall 118 above the inner side wall 116, and a soap dish 130 projects from the bathroom wall 118 beneath the bar 128.

The bathing appliance 100 has a generally H-shaped foot portion 132 including a pair of tubular side bars 134*a*, 134*b* that bend upwardly at their ends so as to lie flush against the bathtub floor over the cross-section of the bathtub 110. The side bars 134*a*, 134*b* are fixed at their centers to a longitudinal base bar 136. A base swivel rod 138 is fixed at one end to a central portion of the base bar 136, and the rod 138 extends vertically upward to engage the swivel sleeve 84 of the lower extension member 78.

A pair of vertical end bars 140*a*, 140*b* are fixed (e.g., welded) at their lower ends to the side bars 134*a*, 134*b* in the regions where the bars are fixed to the base bar 136. The vertical bars, 140*a*, 140*b* are joined at their upper ends to leg bars 142*a*, 142*b*. The vertical bars 140*a*, 140*b* are of a height sufficient to support the leg bars 142*a*, 142*b* clear of the top edges of the bathtub sides wall 112, 116. Each leg bar is generally "L"-shaped and has a horizontal portion secured at one end by, e.g., a rubber pad or suction cup to the surface of wall 118 just above the side wall 116 of the bathtub 110. Each leg bar also has an outside leg portion extending over the bathtub wall 112, to stand on the bathroom floor surface 114 adjacent the wall 112. The outside leg portions have foot pads 144*a*, 144*b* that are adjustable in the vertical direction and can be brought into contact with the floor surface 114 so as to stabilize the appliance 100 inside the bathtub 110.

Because the height of the swivel sleeve 84 of the lower extension member 78 may not be as great as the height of the bathtub walls 112, 116, the horizontal tubular member 82 of the lower extension member 78 must not be longer than one-half the cross-section width of the bathtub opening. That is, when the lower extension member 78 is placed over base swivel rod 138 on the base bar 136, the extension member 78 should be free to swivel over a 360 degree arc without interference by the bathtub side walls 112, 116. When the upper extension member 66 has its swivel sleeve 72 placed over the pivot rod 80 of the lower extension member, the horizontal tubular member 70 of the upper extension member 66 should swing freely above the side wall 112 of the bathtub. Thus, the chair seat 42 can be swung out and over the floor surface 114, next to the bathtub side wall 112. A person may then either mount or dismount the chair seat at an outside position next to the bathtub 110, and the seat will support the person as the seat is swung inside the bathtub to allow the person to bathe comfortably.

While the foregoing description represents preferred embodiments of the invention, it will be obvious to those skilled in the art that various changes and modifications may be made, without departing from the true spirit and scope of the invention as pointed out in the following claims.

What I claim is:

1. A bathing appliance for enabling a handicapped person to bathe comfortably inside a bathing enclosure having vertical side walls, an outer entry wall or step, and an inside floor bounded by said walls, comprising:

a base frame dimensioned and arranged to rest on the inside floor of said bathing enclosure;

said base frame having a perimeter parts of which reach near each of the walls of the bathing enclosure when the base frame rests on said inside floor;

a chair seat on which the handicapped person can sit when entering and leaving the bathing enclosure, and while bathing inside the enclosure;

said chair seat having a bottom portion and first swivel means fixed beneath said bottom portion to allow the chair seat to be supported for relative movement over said base frame;

said base frame having second swivel means fixed to a portion of the base frame, for forming a fixed base pivot axis that is normal to the floor of the bathing enclosure, and an outside foot portion that extends from a part of the base frame when resting on said inside floor to span the outer entry wall or step of the bathing enclosure, said foot portion including outside floor contact means for contacting an outside floor surface next to the bathing enclosure;

extension means having third swivel means at a top end for engaging the first swivel means of said chair seat for relative swiveling movement about an extension axis parallel to the base pivot axis, and fourth swivel means at a bottom end of the extension means for engaging the second swivel means of said base frame for relative swiveling movement about the base pivot axis;

wherein said extension means is constructed and arranged to support the chair seat above the base frame while allowing the seat to be moved between a position outside the bathing enclosure at which a person can either mount or dismount said seat, and a position inside the bathing enclosure at which the person can bathe comfortably while seated.

2. A bathing appliance according to claim 1, wherein the bathing enclosure is a shower enclosure having an entry step, and said outside foot portion is formed to extend over said entry step to stand on a floor surface just outside the shower enclosure.

3. A bathing appliance according to claim 2, wherein said outside floor contact means includes foot pad members, and means for adjusting each of the foot pad members to contact the floor surface just outside the shower enclosure when said base frame rests on the inside floor of the shower enclosure.

4. A bathing appliance according to claim 3, wherein said outside foot portion comprises inverted U-shaped members each of which is fixed at one end to a part of the base frame adjacent a step of the shower enclosure, and said foot pad members of the outside floor contact means are attached at the other ends of said U-shaped members.

5. A bathing appliance according to claim 1, wherein the bathing enclosure is a bathtub having a side wall, and said base frame means includes an outside leg portion that extends over said side wall to stand on an outside floor surface adjacent the bathtub side wall.

6. A bathing appliance according to claim 1, wherein the second swivel means is positioned with respect to the base frame so that the base pivot axis is normal to a central region of the floor of the bathing enclosure.

7. A bathing appliance according to claim 1, wherein said base frame means has an H-shaped foot portion of such a size as to fit flush against a floor of a bathtub.

8. A bathing appliance according to claim 1, wherein said base frame includes means for adjusting side dimensions of the base frame so that sides of the base frame are adjacent to sides of a shower enclosure.

9. A bathing appliance according to claim 1, wherein said extension means comprises a first rigid extension member and a second rigid extension member pivoted to one another for relative swiveling movement about an axis parallel to said extension axis.

10. A bathing appliance according to claim 9, wherein said first extension member has said third swivel means at a top end of the member and is pivoted to an end of the second extension member opposite the top end, and said second extension member has said fourth swivel means at a bottom end opposite to the end of the second extension member that is pivoted to the first extension member.

11. A bathing appliance according to claim 9, wherein each of said first and said second extension members is formed so that said chair seat can be located at any desired position within said bathing enclosure in response to swiveling movement of said extension members relative to one another and to said base frame.

12. A bathing appliance according to claim 1, wherein said outside floor contact means includes foot pad members, and means for adjusting each of the foot pad members to contact the outside floor surface when said base frame rests on the inside floor of the bathing enclosure.

13. A bathing appliance according to claim 11, wherein said outside foot portion comprises inverted U-shaped members each of which is fixed at one end to a part of the base frame adjacent said outer entry wall or step, and said foot pad members of the outside floor contact means are attached at the other ends of said U-shaped members.

* * * * *